United States Patent [19]

O'Brien

[11] Patent Number: 4,644,593

[45] Date of Patent: Feb. 24, 1987

[54] VARIABLE SUPPORT CUSHION FOR SUPPORTING ANATOMICAL BODY WEIGHT

[76] Inventor: James A. O'Brien, 450 Villa, Dubuque, Iowa 52001

[21] Appl. No.: 785,895

[22] Filed: Oct. 9, 1985

[51] Int. Cl.[4] ..... A47C 23/04

[52] U.S. Cl. ..... 5/60; 5/447; 297/284

[58] Field of Search ..... 5/60, 66, 446, 447, 5/437, 68; 128/33; 297/284, 312

[56] References Cited

U.S. PATENT DOCUMENTS

| | | | |
|---|---|---|---|
| 958,356 | 5/1910 | Bode | 5/447 |
| 2,445,158 | 7/1948 | Sparhawk | 5/60 |
| 2,664,882 | 1/1954 | Parker | 128/33 |
| 2,673,357 | 3/1954 | Brandwein | 5/447 |
| 2,773,498 | 12/1956 | Himmelman | 5/60 |
| 2,945,244 | 7/1960 | Lincoln | 5/447 |
| 3,288,525 | 11/1966 | Cerf | 297/284 |
| 3,656,190 | 4/1972 | Regan | 5/60 |
| 4,222,137 | 9/1980 | Usami | 5/446 |

FOREIGN PATENT DOCUMENTS

| | | | |
|---|---|---|---|
| 1000080 | 2/1952 | France | 128/33 |
| 7313917 | 4/1975 | Netherlands | 5/60 |

*Primary Examiner*—John E. Murtagh

*Attorney, Agent, or Firm*—Wood, Dalton, Phillips, Mason & Rowe

[57] ABSTRACT

A variable support apparatus for supporting anatomical body weight. A supporting cusion, such as a mattress or a seat cushion, is provided with at least one relief device at a given location normally under a particular anatomical body area of a user. The relief device is periodically drawn inwardly or toward the bottom surface of the supporting cushion, compressing at least a portion of the cushion, to thereby provide pressure relief at that given location.

19 Claims, 7 Drawing Figures

FIG. 1
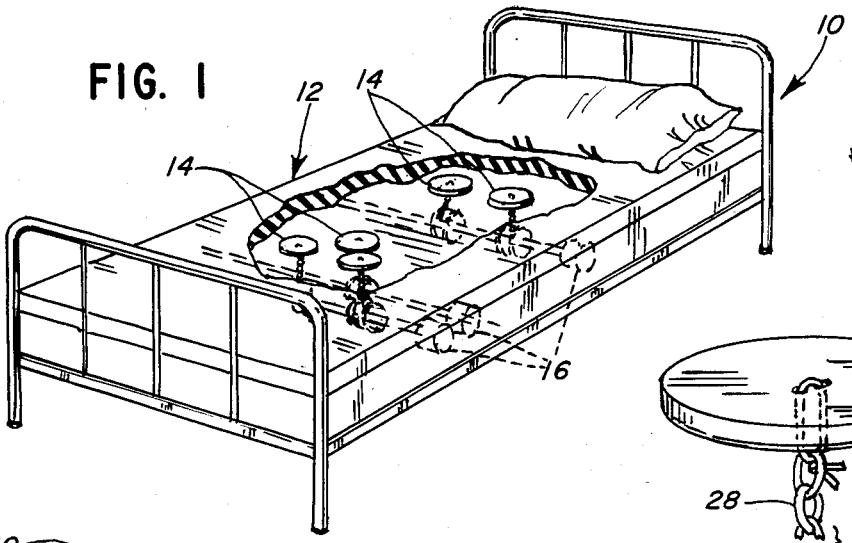
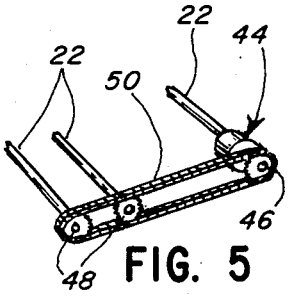
FIG. 5
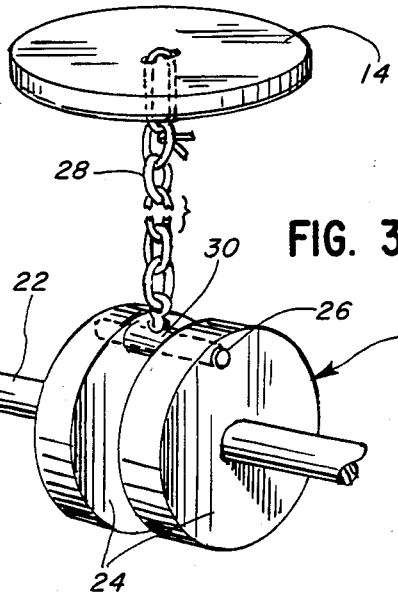
FIG. 3
FIG. 2
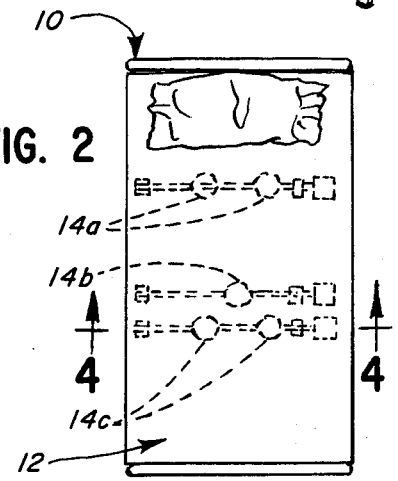
FIG. 6
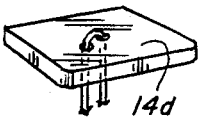
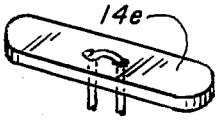
FIG. 7
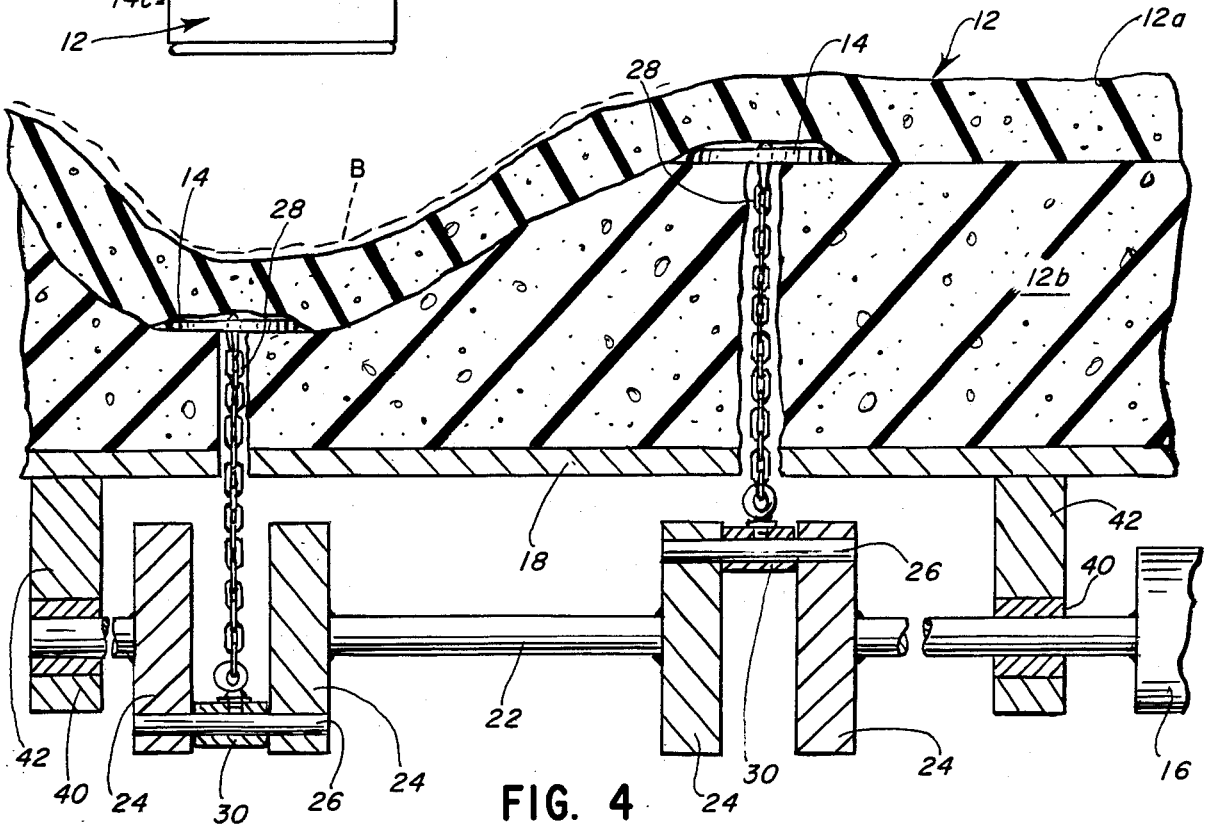
FIG. 4

VARIABLE SUPPORT CUSHION FOR SUPPORTING ANATOMICAL BODY WEIGHT

BACKGROUND OF THE INVENTION

This invention relates to variable support apparatus, such as mattresses, seat cushions or the like, for supporting anatomical body weight and to provide pressure relief for a user.

One of the major problems in caring for patients in hospitals or other facilities during extended-care conditions, is that the patient may be required to spend relatively long periods of time lying in bed or sitting in a cushioned chair. As a result of such confined bed-rest, and the consequential constant pressure on various anatomical body areas of the patient, bed-sores often are acquired. The most prominent locations where this problem occurs are under the patient's hips, under the sacral spine and under the scapulae or shoulder blades. These pressure points which support a great deal of body weight when the patient is confined for long-term bed-rest must have periodic relief or else bed-sores result. This is a continuing and serious problem, particularly where the patient is substantially immobile.

This invention is directed to solving these problems by providing a cushion support apparatus which has means providing a variation in the support and configuration of the cushion or mattress which supports body weight. A prime area for utilizing the invention is in mattresses or like supporting cushions. Another application for the invention would be in vehicular seat cushions, such as truck seat cushions where the driver is required to drive long hauls without appreciable relief.

SUMMARY OF THE INVENTION

An object, therefore, of the invention is to provide a variable support apparatus for supporting anatomical body weight.

Another object of the invention is to provide a mattress or other cushion article having built-in pressure relief areas and for periodically relieving the pressure under a user at those areas.

In the exemplary embodiment of the invention, the variable support apparatus includes a supporting cushion, such as a mattress, seat cushion or the like, having a top surface and a bottom surface. At least one relief device is built into the supporting cushion at a given location normally under a particular anatomical body portion of a user. Motive means is operatively associated with the relief device for periodically drawing the relief device toward the bottom surface of the supporting cushion, compressing at least a portion of the cushion, to thereby providing pressure relief at that given location or locations.

In the preferred embodiment, the relief device is embedded in the supporting cushion closer to the top surface than the bottom surface thereof. The cushion is illustrated in the form of a mattress having a top layer and a bottom layer, with the relief device sandwiched between the layers. In the case of a variable support mattress, a plurality of relief devices are embedded in the mattress at different locations corresponding to different anatomical body areas of a user, such as the hips, the sacral spine and the shoulder blades. The relief devices are in the form of generally flat pads or discs.

The motive means is illustrated in the form of motors mounted below the supporting cushion or mattress. The motors drive a plurality of eccentric devices beneath the cushion. Each eccentric device is connected by a flexible link to each relief device or pad to permit the relief device to be pulled downwardly toward the bottom surface of the cushion, but to permit the natural resiliency of the cushion to return the relief device to its normal position.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of a bed having a mattress which is partially broken away to illustrate certain components of the invention;

FIG. 2 is a top plan view, on a reduced scale, of the bed of FIG. 1;

FIG. 3 is a fragmented exploded view, on an enlarged scale, illustrating one of the relief devices operatively associated with the mattress;

FIG. 4 is a fragmented vertical section, on an enlarged scale, taken generally along line 4—4 of FIG. 2;

FIG. 5 illustrates an embodiment wherein a single motor drives all of the relief devices; and FIGS. 6 and 7 illustrate different shapes or configurations of the relief pads.

DETAILED DESCRIPTION OF THE PREFERRED EMBODIMENT

Referring to the drawings in greater detail, and first to FIG. 1, the variable support apparatus of the invention is illustrated herein as embodied in a bed, such as a hospital bed generally designated 10, which includes a mattress, generally designated 12. Generally, the invention contemplates one or more relief devices including generally flat pads or discs 14 embedded in the mattress at selected locations normally under particular anatomical body portions of a user. Motive means in the form of motors 16 are operatively associated with relief pads 14 for periodically drawing the relief pads toward the bottom surface of the mattress, compressing portions of the mattress, to thereby provide pressure relief at the selected locations.

For instance, when a patient is confined to long-term bed-rest, the most susceptible body areas which are subject to constant pressure are under the patient's hips, under the sacral spine and under the scapulae or shoulder blades. Consequently, FIG. 2 shows two relief pads **14*a* located in the normal area of a patient's shoulder blades, at least one relief pad 14*b* located in the area of the sacral spine and a pair of relief pads 14*c*** located in the area of the hips. Of course, it should be immediately pointed out that this is but one illustration of the utility and application of the invention. Other applications are apparent, such as using variable support relief in seat cushions or the like. A vehicular seat is but one example.

FIGS. 3 and 4 show the various operative components for actuating relief pads 14 for periodically drawing the pads inwardly for pressure relief. More particularly, relief pads 14 are embedded within the supporting cushion. The pads may be embedded in the cushion closer to the top surface than the bottom surface of the cushion. In the case of the mattress 12 illustrated herein, the mattress includes a top layer 12*a* and a bottom layer 12*b*, with the top layer being thinner than the bottom layer, and with relief pads 14 sandwiched between the layers. For instance, the top layer may comprise a one or two-inch foam layer overlying a four-inch foam layer. The mattress may be supported on a rigid bottom support panel 18.

Periodic movement of relief pads 14 is provided by eccentric devices, generally designated 20, mounted on shafts 22 extending laterally beneath the mattress. Each eccentric device 20 includes a pair of generally parallel disc members 24 concentrically mounted on the respective shaft 22. An eccentric pin 26 spans each pair of discs and is connected to a respective relief pad 14 by flexible linkage. The flexible linkage may take the form of a flexible chain 28. The linkage may also comprise a flexible cable. The flexible chain or cable is secured to a sleeve or bushing 30 which is freely rotatable about pin 26 to prevent entanglement of the chain. Such flexible linkage permits the relief pads to be pulled downwardly, inwardly of the mattress by eccentric devices 20, compressing the mattress, but the flexibility of the linkage permits the natural resiliency of the mattress to return the relief devices to their normal position depending upon the position of an occupant of the bed. FIG. 4 shows the left-hand relief pad 14 having been pulled downwardly to its extreme limit position. The right-hand relief pad 14 is illustrated in its upper-most limit position. It should be noted that the contour of mattress layer 12*a* in FIG. 4 is shown indented in a somewhat exaggerated condition. This would happen only if a portion of an occupant's body "B" would force the top layer into the compressed recess of the bottom layer. Otherwise, the top layer simply would span the recess and flex into the recess an extent depending on the pressure of an occupant at that location.

Relief pads 14 and their eccentric devices 20 are operated by appropriate motive means for rotating the respective shafts 22. For instance, FIGS. 1 and 4 show an individual motor 16 connected directly to each shaft 22 for driving the shaft individually. It also is contemplated that the motive means could be a hand crank connected to one or more shafts 22 for adjusting or depressing relief pads 14 as needed to vary the pressure points within the mattress. The shafts are journalled in bearings 40 (FIG. 4) supported in brackets 42 depending from the underside of support panel 18. The timing of periodically drawing the relief pads inwardly of the mattress is determined by the particular angular location of eccentric pin 26 between discs 24. Any desired timing or alternating movement of the various relief pads can be designed. The motor would be relatively slow, rotating the shafts one or several revolutions per minute. Should the invention be incorporated in a vehicular seat cushion, the speed of the motor might be on the order of only one revolution per minute.

An alternative motive means is shown in FIG. 5 wherein a single electric motor 44 can be mounted beneath support panel 18 (FIG. 4). The motor is mounted on and drives one of the shafts 22 which terminate in a drive sprocket 46. The other shafts 22 also terminate in sprockets 48. A drive chain 50 spans sprockets 46,48 whereby the motor simultaneously rotates all shafts 22. In this manner, single motor 44 operates all of relief pads 14.

FIGS. 6 and 7 show different shapes for relief pads 14 to accommodate a variety of body measurements or areas. FIG. 6 shows a square pad 14*d* and FIG. 7 shows an elongated or oblong pad 14*e*.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A variable support apparatus for supporting anatomical body weight, comprising:

a supporting cushion with a top surface and a bottom surface;

at least one relief device including a pressure member on the supporting cushion at a given location normally under a particular anatomical body portion of a user, and flexible linkage means connected to the pressure member and extending through the supporting cushion; and powered motive means mounted below the supporting cushion and operatively connected to said flexible linkage means for intermittently pulling the pressure member toward the bottom surface of the supporting cushion, compressing at least a portion of the cushion, to thereby provide pressure relief at that given location but permitting the natural resiliency of the cushion to return the pressure member to its normal position.

2. The variable support apparatus of claim 1 wherein the pressure member is embedded in the supporting cushion closer to the top surface than the bottom surface thereof.

3. The variable support apparatus of claim 2 wherein the pressure member is in the form of a generally flat pad.

4. The variable support apparatus of claim 3 wherein the supporting cushion includes a top layer and a bottom layer, with the pressure member sandwiched between the layers.

5. The variable support apparatus of claim 1 wherein said motive means includes an eccentric drive for providing said intermittent pulling of the pressure member.

6. The variable support apparatus of claim 1 wherein the pressure member is in the form of a generally flat pad.

7. The variable support apparatus of claim 6 wherein the pressure member is embedded in the supporting cushion closer to the top surface than the bottom surface thereof.

8. The variable support apparatus of claim 1, including a plurality of said relief devices on the supporting cushion at different locations corresponding to different anatomical body areas of a user.

9. The variable support apparatus of claim 8 wherein the supporting cushion is in the form of a mattress, and at least one relief device is located in each of the normal shoulder and hip areas of the mattress.

10. The variable support apparatus of claim 8 wherein all said relief devices are operatively associated with a single motive means.

11. A variable support mattress, comprising:

a mattress body;

a plurality of relief devices on the mattress body substantially spaced from each other and located in each of the normal shoulder and hip areas of the mattress; and powered motive means mounted below the mattress body and operatively connected to the relif devices by flexible means through the mattress body for intermittently pulling the relief devices inwardly, compressing portions of the mattress body, to thereby provide periodic pressure relief at said locations.

12. The variable support mattress of claim 11 wherein said relief devices are embedded in the mattress body closer to the top surface than the bottom surface thereof.

13. The variable support mattress of claim 12 wherein the mattress body includes a top layer and a bottom layer, with the relief devices sandwiched between the layers.

14. The variable support mattress of claim 12 wherein said relief devices are in the form of generally flat pads.

15. The variable support mattress of claim 11 wherein said motive means include eccentric drive means for providing said drawing of the relief devices.

16. The variable support mattress of claim 15 wherein said linkage means comprise a flexible link between the motive means and each relief device which permits the relief devices to be pulled downwardly but permits the natural resiliency of the mattress body to return the relief devices to their normal position.

17. The variable support mattress of claim 15 wherein said motive means include a single motor and a plurality of eccentric drive devices operatively connected to the motor and each eccentric drive device being operatively connected by linkage means to a respective one of the relief devices.

18. The variable support mattress of claim 17 wherein at least some of said relief devices are spaced longitudinally of the mattress body, each eccentric drive device including a drive shaft extending laterally of the mattress body and having a drive pulley thereon, and the single drive motor being connected to the drive pulleys by a common pulley belt.

19. The variable support apparatus of claim 11, including another of said relief devices located in the normal sacral spine area of the mattress.

* * * * *